US006932039B2

(12) United States Patent
Takahashi et al.

(10) Patent No.: US 6,932,039 B2
(45) Date of Patent: Aug. 23, 2005

(54) VALVE TIMING ADJUSTING APPARATUS

(75) Inventors: Kinya Takahashi, Obu (JP); Tomonari Chiba, Nishikamo-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/991,449

(22) Filed: Nov. 19, 2004

(65) Prior Publication Data

US 2005/0109299 A1 May 26, 2005

(30) Foreign Application Priority Data

Nov. 20, 2003 (JP) ..... 2003-391003

(51) Int. Cl.[7] ..... F01L 1/34
(52) U.S. Cl. ..... 123/90.17; 123/90.31; 123/90.15
(58) Field of Search ..... 123/90.15, 90.17, 123/90.31

(56) References Cited

U.S. PATENT DOCUMENTS 6,135,077 A 10/2000 Moriya et al.
6,250,266 B1 6/2001 Okui et al.
6,386,164 B1 5/2002 Mikame et al.
2003/0094152 A1 * 5/2003 Katayama ..... 123/90.17

FOREIGN PATENT DOCUMENTS

JP 11-2107 1/1999
JP 2000-179314 6/2000

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

A valve timing adjusting apparatus comprises a first rotating body adjusting the opening/closing timing of the intake valves, and a second rotating body adjusting the opening/closing timing of exhaust valves. A first and a second driving force transmitting members respectively have first and second endless members for power transmission. The peripheral shape of the second rotating body comprises a circumferential shape portion and cutoff shape portions whose distance from the center of rotation is smaller than the circumferential shape portion's. When the first and second rotating bodies are assembled to an internal combustion engine, the cutoff shape portions are positioned in such a rotation angle position that the first endless member for power transmission can be inserted into the gap between the first and second rotating bodies.

10 Claims, 10 Drawing Sheets

VALVE TIMING ADJUSTING APPARATUS

CROSS REFERENCE TO RELATED APPLICATION

This application is based on Japanese Patent Application No. 2003-391003 filed on Nov. 20, 2003, the disclosure of which is incorporated herein by reference.

FIELD OF THE INVENTION

The present invention relates to valve timing adjusting apparatuses. The present invention is favorably applicable to valve timing adjusting apparatuses which operate as follows: they change the opening/closing timing of at least either the intake valves or the exhaust valves of, for example, an internal combustion engine (hereafter, referred to as "engine") for vehicles according to the operating conditions.

BACKGROUND OF THE INVENTION

Conventionally, there have been various methods for controlling valve timing. One of the examples is as follows: camshafts are driven by driving force transmitting means, such as chains and sprockets, which are rotated in synchronization with the crankshaft of an engine. A phase difference due to relative rotation between the driving force transmitting means and the camshafts is produced by hydraulic control. Then, the valve timing of at least either intake valves or exhaust valves is controlled by this phase difference. Apparatuses for this purpose include helical and vane valve timing adjusting apparatuses. (Refer to JP-11-141313A, JP-2000-179314A, JP-2000-170509A, JP-11-2107A, and JP-2000-192806A.) When these types of valve timing adjusting apparatuses are used, they are rotated together with camshafts. Therefore, to reduce the amount of imbalance in the apparatuses as rotating bodies and reduce the space required for the apparatuses as rotating bodies, the following procedure is basically taken when designing these valve timing adjusting apparatuses: a valve timing adjusting apparatus is designed as a substantially cylindrical body whose contour is circular, as much as possible.

According to the techniques disclosed in JP-2000-179314A, JP-2000-170509A, and JP-11-2107A, a valve timing adjusting apparatus is constituted of a housing which is rotated together with a driving force transmitting member, such as a timing chain; and a vane rotor which is rotated together with a camshaft and is rotatable in the holding chamber in the housing. The vane rotor as built-in part changes its angle in synchronization with camshaft phase; therefore, it is also formed as substantially cylindrical body. The housing and sprockets as external parts are also formed in substantially cylindrical shape so that their thickness will be uniform.

The valve timing adjusting apparatuses disclosed in JP-2000-179314A and JP-2000-170509A adopt four vanes. That disclosed in JP-11-2107A adopts three vanes. The four vanes and the three vanes are respectively formed at equal angular intervals of 90° and 120°, and thereby the amount of rotational imbalance is reduced.

According to the technique disclosed in JP-2000-192806A, the following constitution is adopted: the camshafts for intake and for exhaust of the left and right banks of a V-type engine are mounted with a valve timing adjusting apparatus for intake and a valve timing adjusting apparatus for exhaust, respectively. Within each bank, the valve timing adjusting apparatuses for intake and for exhaust are so constituted that they are rotated with the same number of revolutions through a second timing chain. The valve timing adjusting apparatuses for exhaust are so constituted that they are rotated with a number of revolutions equal to ½ of the number of revolutions of the crankshaft through a first timing chain.

Recently, the demand for downsizing of engines has grown to ensure a crushable zone in engine rooms and for other purposes. This demand is made as part of the enhancement of the safety performance of vehicles from the viewpoint of pedestrian protection. For this reason, with respect to valve mechanisms as well, the angles of intake and exhaust valves have been increasingly reduced for downsizing, the enhancement of intake and exhaust efficiency, and the like. With respect to DOHC engines, the inter-camshaft pitch between intake camshafts and exhaust camshafts tends to be narrowed. With respect to conventional in-line six-cylinder engines and the like, their large overall length limits the size of the engine room and the like. Therefore, there is a trend toward V-type six-cylinder engines.

Thus, the environment in which valve timing adjusting apparatuses are mounted has been changing. However, if an engine is mounted with valve timing adjusting apparatuses for intake and valve timing adjusting apparatuses for exhaust, a problem arises. There are cases where conventional valve timing adjusting apparatuses in substantially cylindrical shape, according to JP-11(1999)-141313A, JP-2000-179314A, JP-2000-170509A, or JP-11-2107A, do not meet the mounting conditions unless their build as a cylindrical rotating body is changed.

The related art for mounting valve timing adjusting apparatuses for intake and for exhaust on a V-type engine, according to JP-2000-192806, also poses a problem. When valve timing adjusting apparatuses for intake and for exhaust are assembled to the camshafts of an engine, it is required to loop second timing chains over the respective sprocket portions of valve timing adjusting apparatuses for intake and for exhaust. In addition, it is required to loop first timing chains over the sprocket side of valve timing adjusting apparatuses for exhaust to some degree. For this reason, there is the possibility that the workability of assembling valve timing adjusting apparatuses to an engine is degraded.

Timing chains or timing belts develop wear or slack as the result of long-time use or the like. Slack in a timing chain shifts the timing by an amount equivalent to a rotation angle for a sprocket to take up the slack. The first timing chain transmits the rotational driving force of a crankshaft to valve timing adjusting apparatuses for intake and for exhaust. Therefore, the use conditions for the first timing chains are especially strict as compared with the second timing chain. Replacement of a first timing chain may be required depending on the result of inspection for slack and the like. In the related art disclosed in JP-2000-192806A, extensive engine dismantling work involving removal and reinstallation of valve timing adjusting apparatuses and the like is required to replace a first timing chain.

SUMMARY OF THE INVENTION

The present invention has been made with the above-mentioned circumstances taken into account. An object of the present invention is to enhance the mountability of substantially cylindrical valve timing adjusting apparatuses for intake and for exhaust in an internal combustion engine in which the center distance between camshafts is limited.

Another object of the present invention is to provide a valve timing adjusting apparatus wherein the mountability of substantially cylindrical valve timing adjusting apparatuses for intake and for exhaust is enhanced in an internal combustion engine in which the center distance between camshafts is limited and ease of assembling both valve timing adjusting apparatuses to an internal combustion engine is enhanced.

A further object of the present invention is to provide a valve timing adjusting apparatus wherein the mountability of substantially cylindrical valve timing adjusting apparatuses for intake and for exhaust is enhanced in an internal combustion engine in which the center distance between camshafts is limited and the workability of removing and reinstalling timing chains or timing belts and the like is enhanced in market services.

The valve timing adjusting apparatus according to the present invention comprises: a first rotating body which is provided on a first driving force transmitting member for transmitting driving force from the driving shaft of an internal combustion engine to a driven shaft for opening and closing either of intake valves or exhaust valves and adjusts the opening/closing timing of the either; and a second rotating body which is provided on a second driving force transmitting member for transmitting the turning force of the first rotating body to the other driven shaft and adjusts the opening/closing timing of the other. The valve timing adjusting apparatus is characterized by the following: the first driving force transmitting member and the second driving force transmitting member respectively have a first endless member for power transmission and a second endless member for power transmission; with respect to the peripheral shape of the second rotating body, it comprises a circumferential portion and cutoff shape portions whose distance from the center of rotation is shorter than the circumferential portion's. The cutoff shape portions are disposed in such rotation angle positions that, when the first rotating body and the second rotating body are assembled to the internal combustion engine, the first endless member for power transmission can be inserted in between the first rotating body and the second rotating body.

In general, the following can be said with respect to an internal combustion engine mounted with a first rotating body and a second rotating body for adjusting the opening/closing timing of intake valves and exhaust valves (that is, two valve timing adjusting apparatuses, one for intake valves and one for exhaust valves): the number of revolutions of the driven shafts is reduced to ½ of the number of revolutions of the driving shaft. To reduce the size of the driving force transmitting members, one driving force transmitting member (endless member for power transmission) is not looped over both the driven shafts for driving and opening and closing intake valves and exhaust valves and the driving shaft. Then, turning force is transmitted between the driven shafts through the second endless member for power transmission. Further, the second endless member for power transmission and the first endless member for power transmission are looped over the first rotating body. Thus, driving force is directly transmitted from the driving shaft to the first rotating body. The driving force transmitting member comprises a endless member for power transmission, such as a timing chain or a timing belt, and a looped member, such as a sprocket or a pulley, over which the endless member for power transmission is looped. For example, the sprocket portion on the second rotating body side is made smaller than the sprocket portion on the first rotating body side.

However, when conventional substantially cylindrical first rotating body and second rotating body are mounted on an internal combustion engine in which the center distance between driven shafts is limited, a problem arises. Because of the limited center distance, for example, the gap between the first rotating body and the second rotating body is made so small that such an endless member for power transmission as timing chain cannot be inserted therein. As a result, ease of mounting the first rotating body and the second rotating body on the internal combustion engine can be degraded.

Meanwhile, the valve timing adjusting apparatus of the present invention is provided with cutoff shape portions with respect to the peripheral shape of the second rotating body. The cutoff shape portions provide so widened a gap that the first endless member for power transmission can be inserted therein only when the second rotating body is positioned in assembling position at a predetermined rotation angle at which the first rotating body and the second rotating body are assembled to the internal combustion engine. Therefore, the cutoff shape portions only have to be provided in parts of the periphery of the cylindrical shape. Thus, the mountability of the first rotating body and the second rotating body, that is, the valve timing adjusting apparatuses for intake valves and for exhaust valves can be enhanced when they remain in substantially cylindrical shape.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

Figure 1:
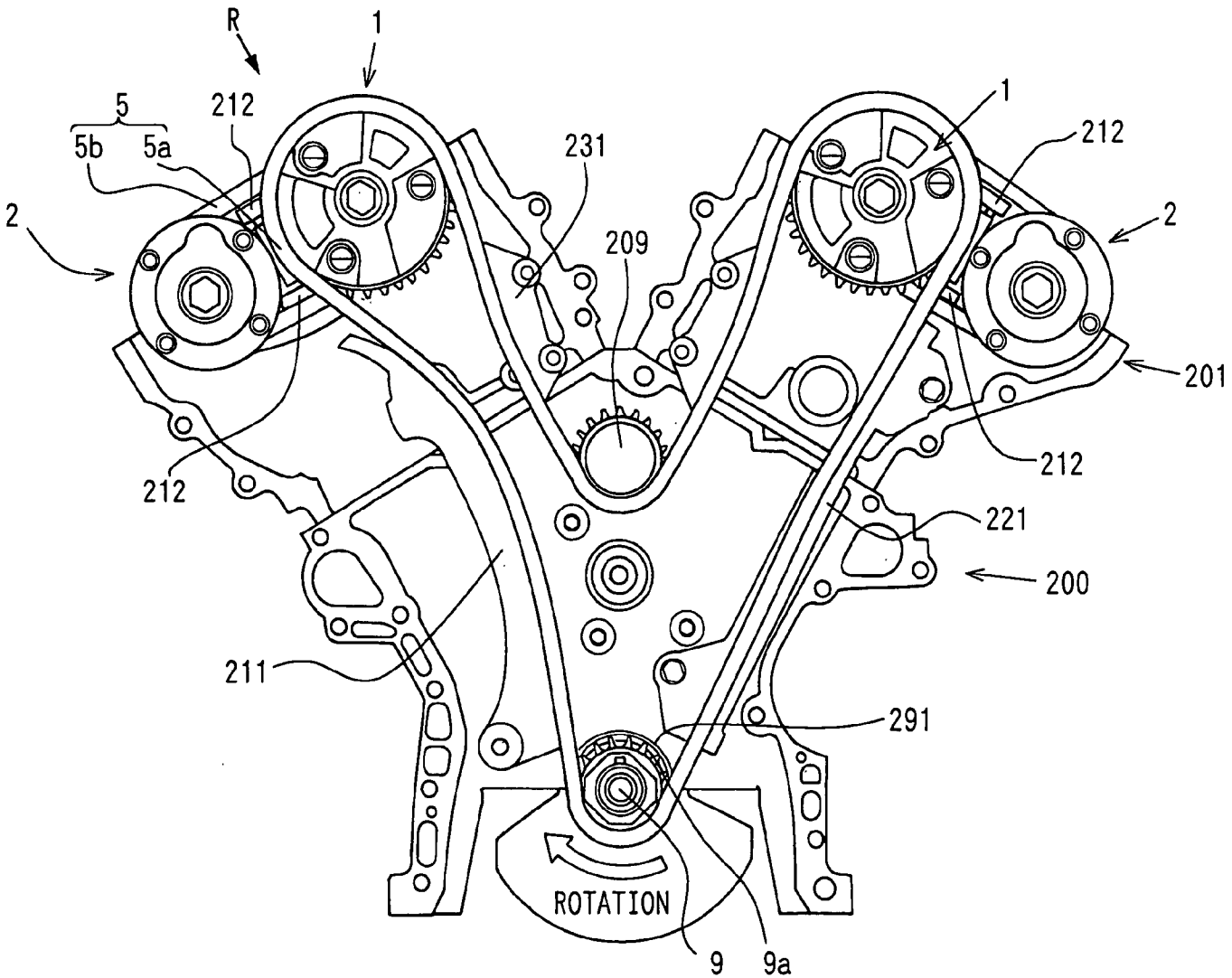
FIG. 1 is a front view partially illustrating an internal combustion engine equipped with the valve timing adjusting apparatuses in an embodiment of the present invention.
Figure 2:
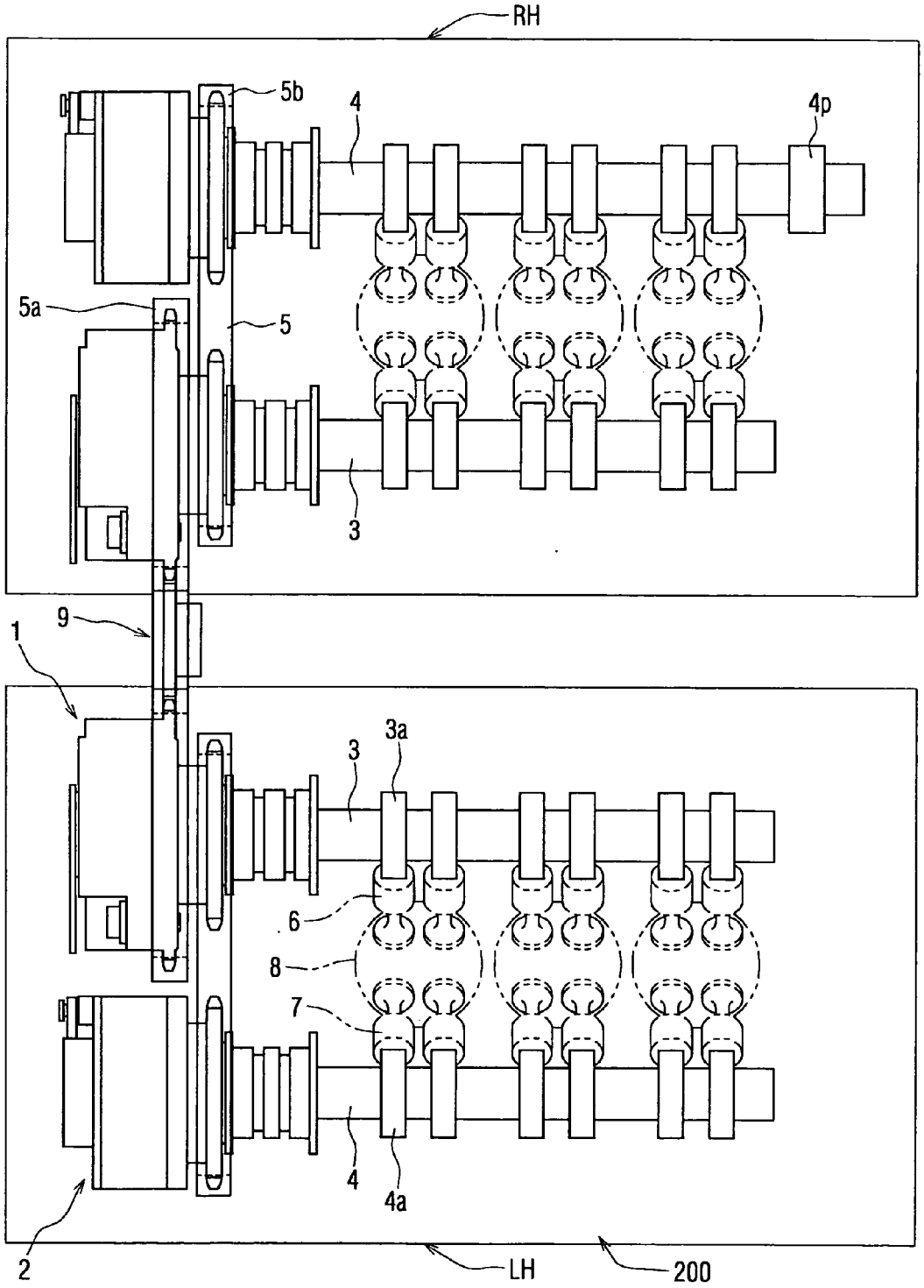
FIG. 2 is a schematic plan view of the internal combustion engine in FIG. 1 as viewed from the cylinder head cover side.
Figure 3:
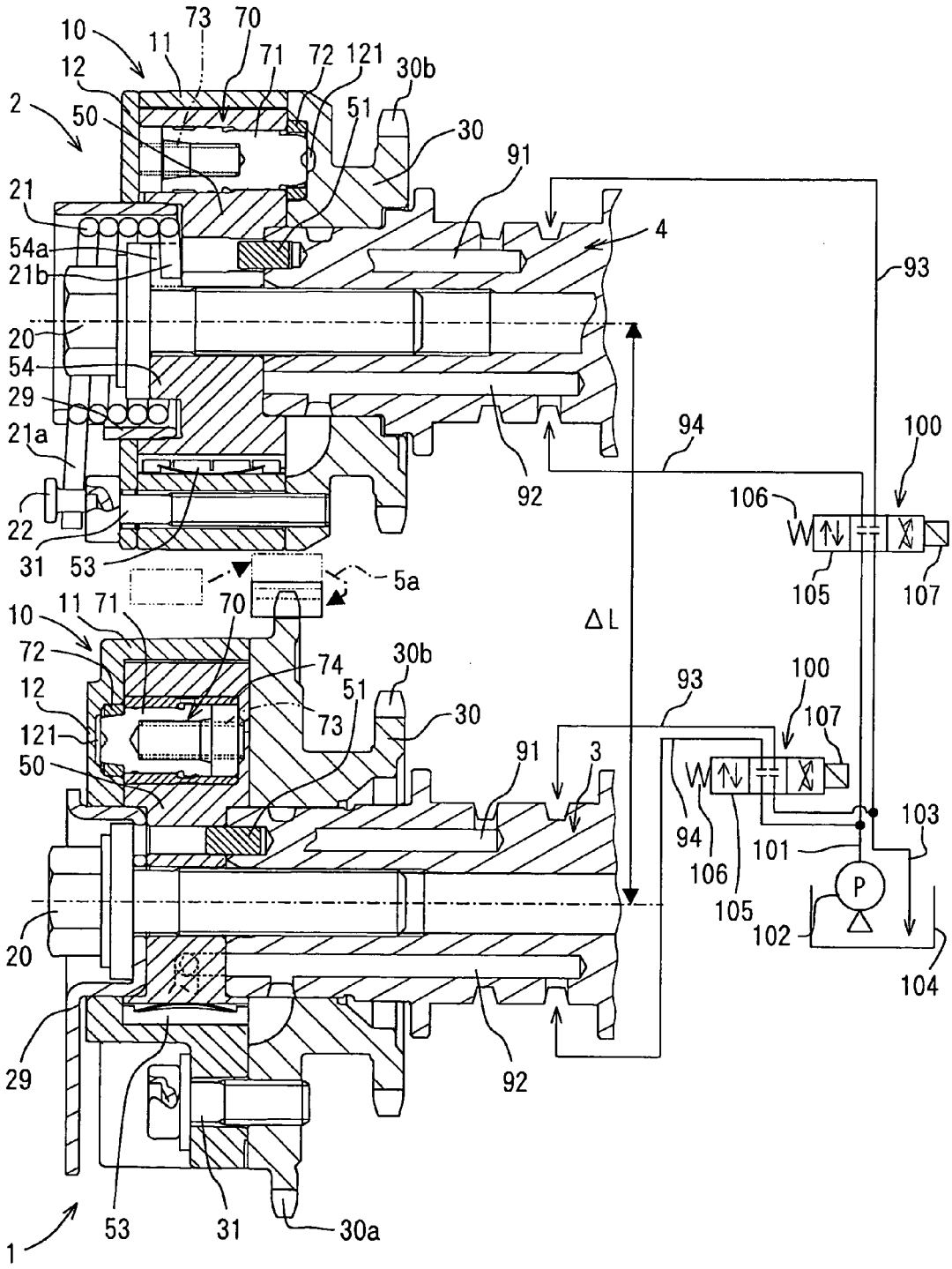
FIG. 3 is a longitudinal sectional view illustrating first and second rotating bodies and driven shafts.
Figure 4:
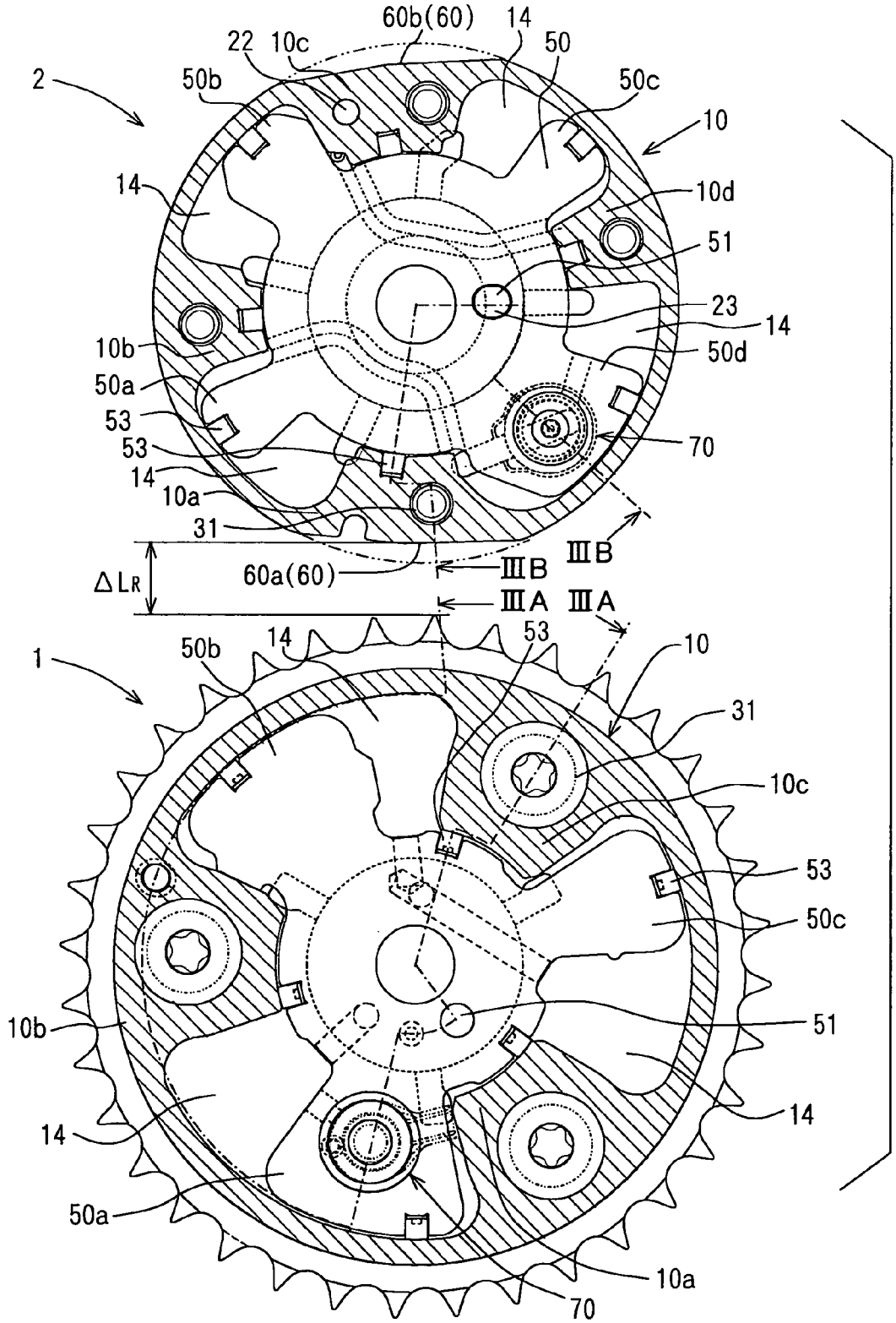
FIG. 4 is a cross-sectional view illustrating the interior of the housing members of first and second rotating bodies.
Figure 5:
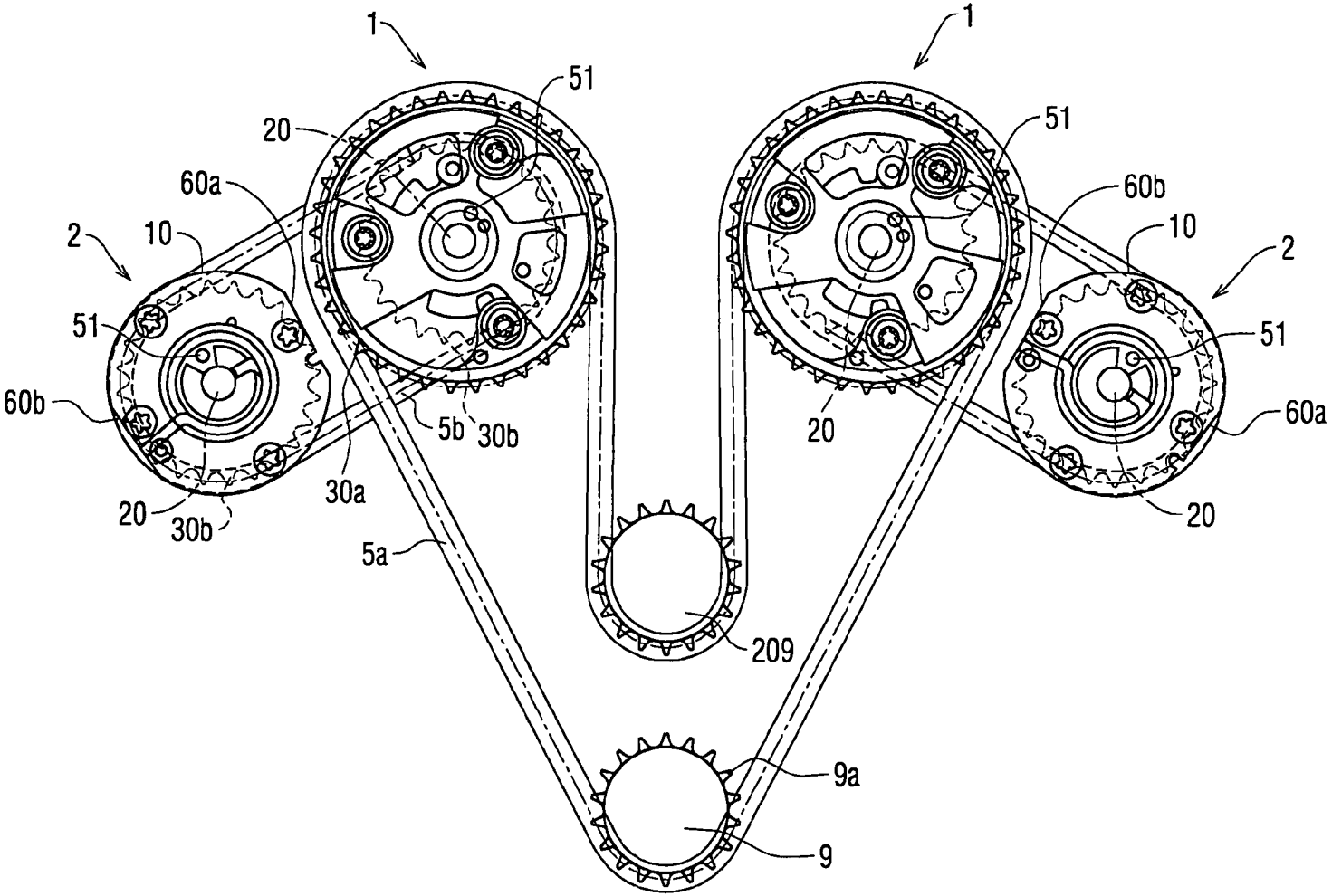
FIG. 5 is a schematic front view illustrating the positional relation between the first and second rotating bodies and the driving force transmission system in FIG. 1.
Figure 6:
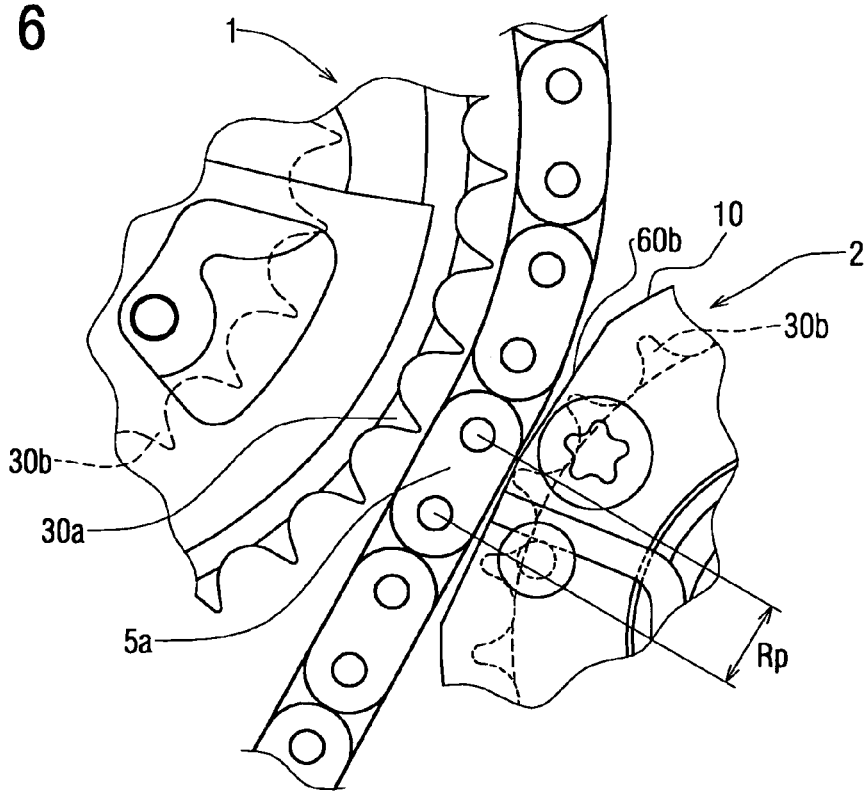
FIG. 6 is a partial front view illustrating a timing chain immediately before the timing chain is looped over the first rotating body.
Figure 7:
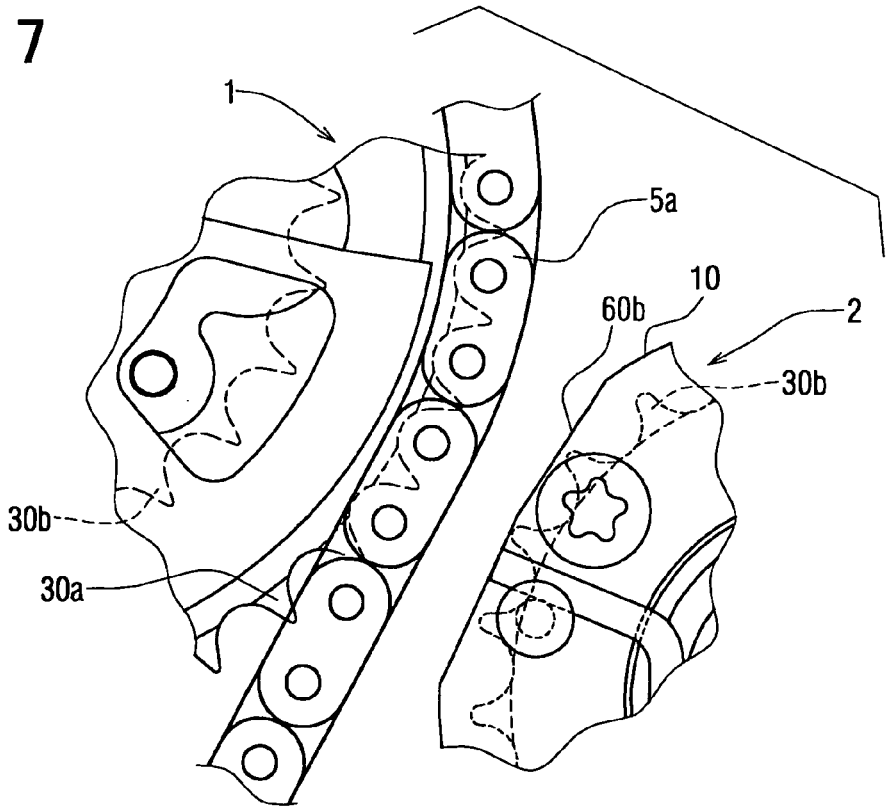
FIG. 7 is a partial front view illustrating a timing chain immediately after the timing chain is looped over the first rotating body.
Figure 8:
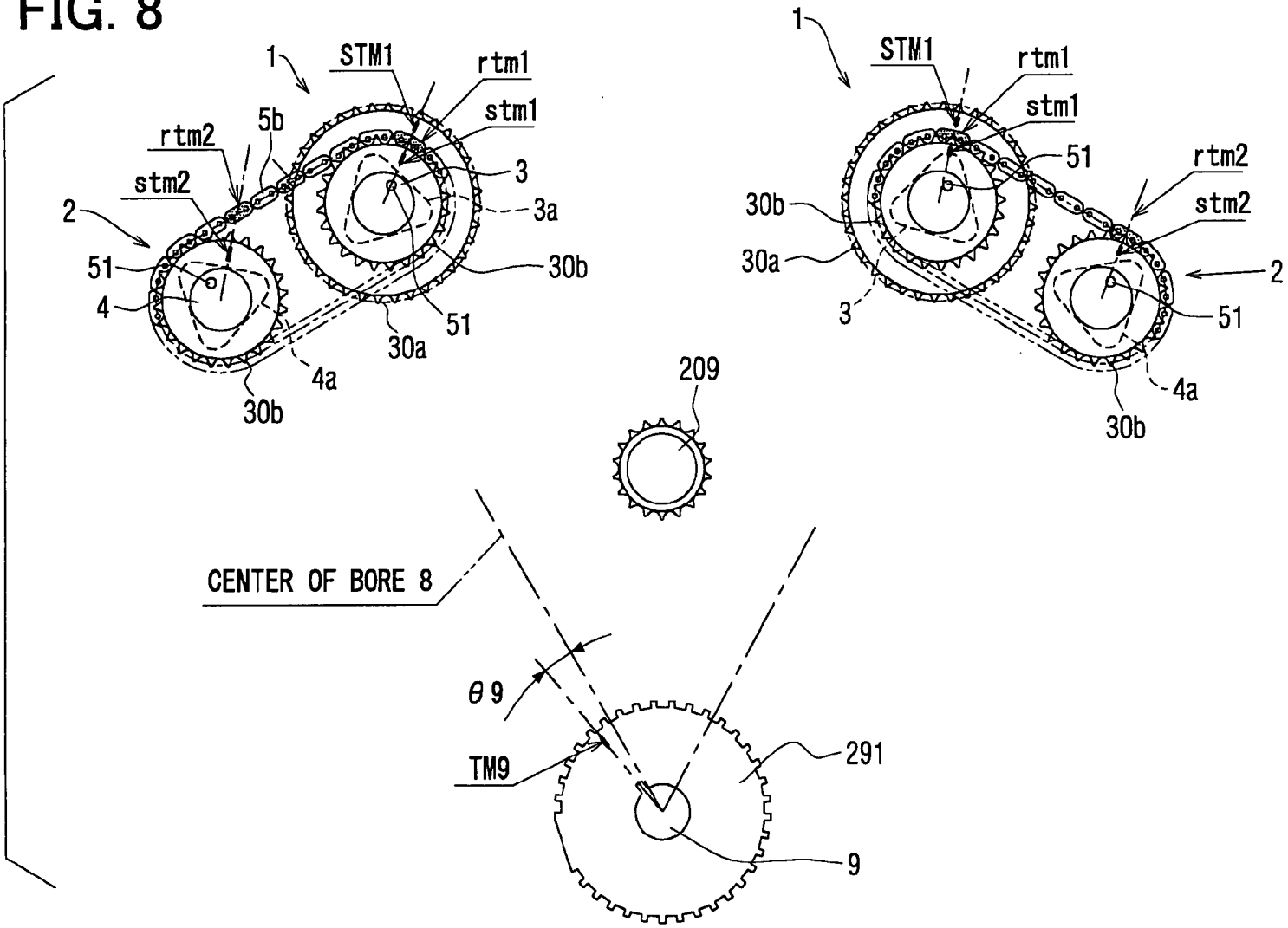
FIG. 8 is a schematic diagram showing a second timing chain looping process in which the second timing chains are looped over the first rotating bodies and the second rotating bodies.
Figure 9:
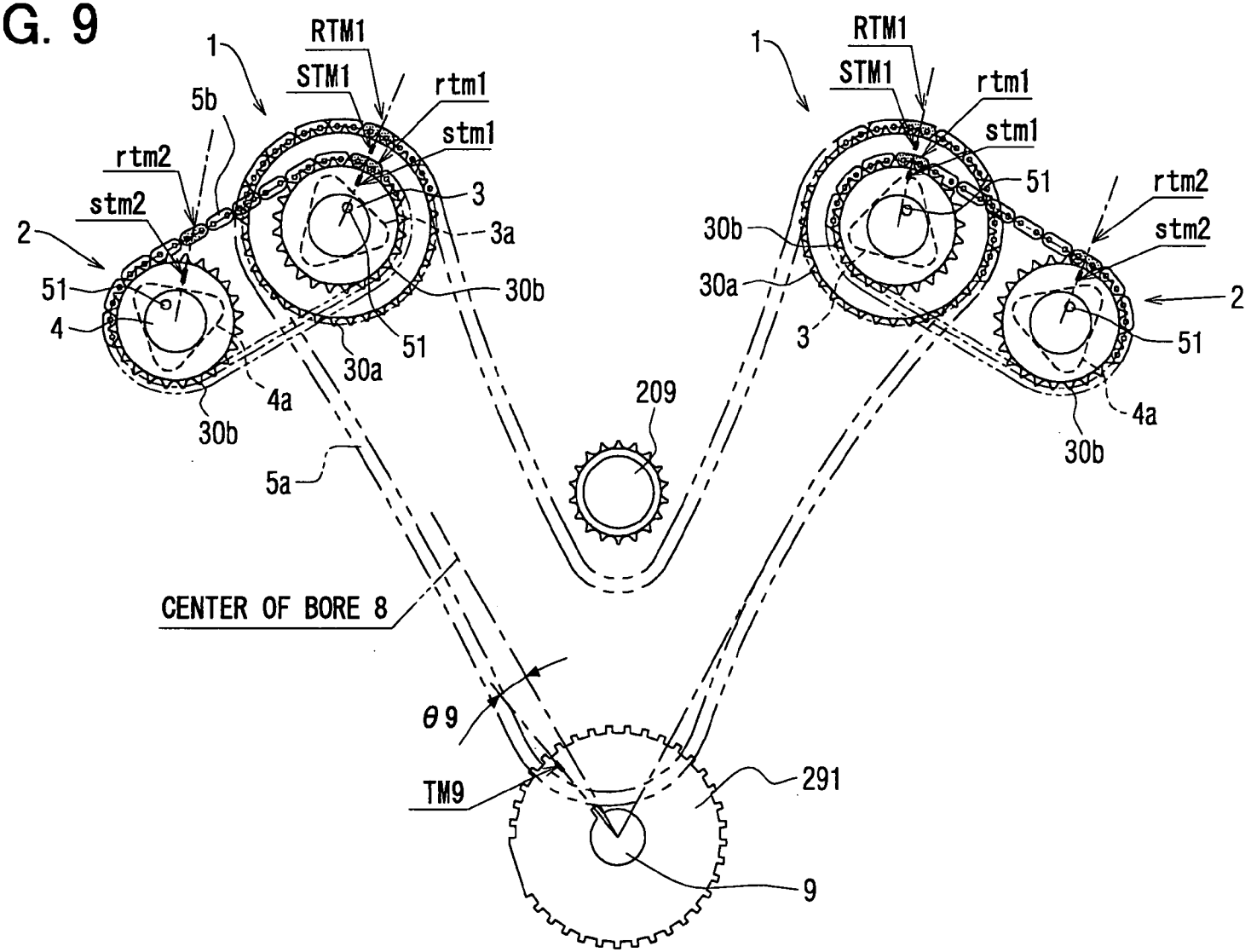
FIG. 9 is a schematic diagram illustrating a state in which valve timing adjusting apparatuses are assembled to an internal combustion engine, and a temporary first timing chain looping process in which the first timing chain is looped over only the first rotating bodies.
Figure 10:
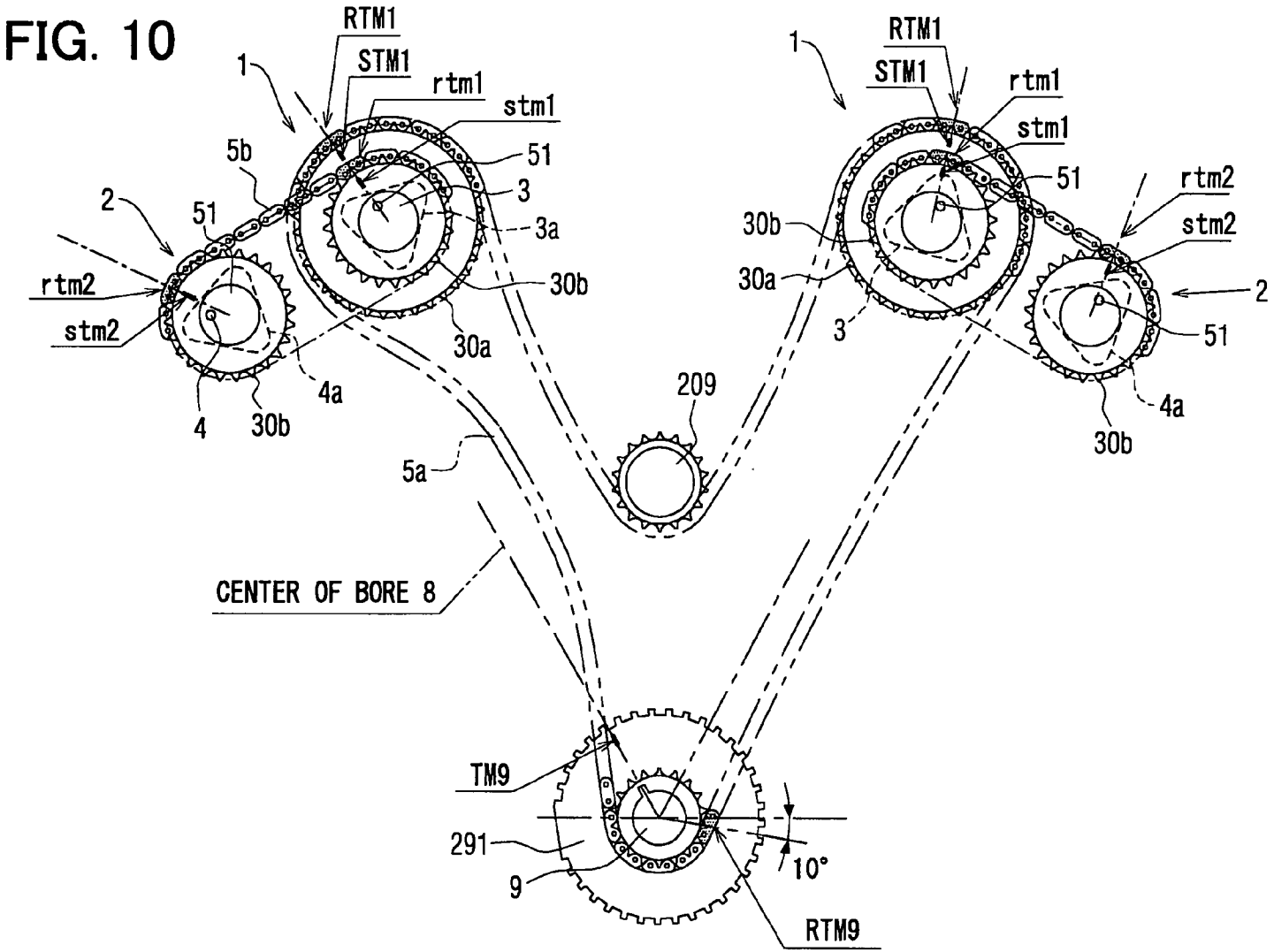
FIG. 10 is a schematic diagram illustrating a state in which valve timing adjusting apparatuses are assembled to an internal combustion engine, and a first timing chain looping process in which the first timing chain is looped over the first rotating bodies and the driving shaft.

Hereafter, embodiments in which the valve timing adjusting apparatus of the present invention is realized will be described referring to the drawings. FIG. 1 is a front view partially illustrating an internal combustion engine equipped with the valve timing adjusting apparatuses in an embodiment of the present invention. FIG. 2 is a schematic plan view of the internal combustion engine in FIG. 1 as viewed from the cylinder head cover side. FIG. 3 is a schematic diagram illustrating the valve timing adjusting apparatuses in this embodiment. This diagram is a longitudinal sectional view illustrating first and second rotating bodies and driven shafts. FIG. 4 is a schematic diagram of the valve timing adjusting apparatuses in this embodiment. This diagram is a cross-sectional view illustrating the interior of the housing members of the first and second rotating bodies. FIG. 5 is a schematic front view illustrating the positional relation between the first and second rotating bodies and the driving force transmission system in FIG. 1. FIG. 6 is a partial front view illustrating a timing chain immediately before the timing chain is looped over the first rotating body. FIG. 7 is a partial front view illustrating a timing chain immediately after the timing chain is looped over the first rotating body. FIG. 8 is a schematic diagram illustrating a state in which valve timing adjusting apparatuses are assembled to an internal combustion engine. The diagram is a drawing of second timing chain looping process in which the second timing chains are looped over the first rotating bodies and the second rotating bodies. FIG. 9 is a schematic diagram illustrating a state in which valve timing adjusting apparatuses are assembled to an internal combustion engine. The diagram is a drawing of temporary first timing chain looping process in which the first timing chain is looped over only the first rotating bodies. FIG. 10 is a schematic diagram illustrating a state in which valve timing adjusting apparatuses are assembled to an internal combustion engine. The diagram is a drawing of first timing chain looping process in which the first timing chain is looped over the first rotating bodies and the driving shaft. In FIG. 5, chain adjusting apparatuses, such as a chain tensioner and dampers, illustrated in FIG. 1, are omitted which remove slack in the chains and automatically adjust the tension of the chains.

As illustrated FIG. 1, an internal combustion engine (hereafter, referred to as "engine") is constituted by stacking the following items in the order of reference: a lower block (not shown) (equivalent to lower crank case) to which an oil pan (not shown) for storing lubrication oil and the like are assembled; cylinder blocks 200 (equivalent to cylinders and upper crank cases); cylinder heads 201, and a cylinder head covers (not shown). As illustrated in FIG. 1 and FIG. 2, this engine is a V-type six-cylinder engine. The tip (front end of FIG. 1) of a driving shaft (hereafter, referred to as "crankshaft") 9 is equipped with a sprocket (hereafter, referred to as "crank sprocket") 9*a* so that the sprocket will be integrally rotatable. The cylinder head is branched in V shape with a cylinder bore 8 at the center. The left part of FIG. 1 (upper part of FIG. 2) constitutes a right bank RH, and the right part of FIG. 1 (lower part of FIG. 2) constitutes a left bank LH.

As illustrated in FIG. 2, six cylinders are provided in the banks RH and LH, three cylinders each. In each bank RH and LH, two driven shafts (hereafter, referred to as "camshafts") 3 and 4 are provided in parallel above the cylinders. The driven shafts are extended in the longitudinal direction with a predetermined center distance ΔL (Refer to FIG. 3.) in-between. Both the banks RH and LH are constituted as follows: an intake pipe (not shown), extended from the upper part of the FIG. 1, is connected to the intake manifold of the cylinder head between the banks RH and LH; and an exhaust pipe (not shown) connecting to the exhaust manifold of the cylinder head is disposed outside the banks RH and LH. As illustrated in FIG. 2, the intake-side camshafts 3 have cams 3*a* for opening and closing intake valves 6 formed, two cams per cylinder. The exhaust-side camshafts 4 have cams 4*a* for opening and closing exhaust valves 7 formed, two cams per cylinder. A cam 4*p* for driving a high-pressure fuel supply pump for direct injection may be provided on any one of the four camshafts 3 and 4. (In this embodiment, the cam 4*p* is provided on the exhaust-side camshaft 4 in the right bank RH.)

In each bank RH and LH, a plurality of bearings (not shown) are disposed at intervals in the direction of the axis of each camshaft 3 and 4. The camshafts 3 and 4 are rotatably supported by the bearings.

To transmit the rotation of the crankshaft 9 to each intake-side camshaft 3, the tip (front end) of each intake-side camshaft 3 is integratively equipped with a sprocket (hereafter, referred to as "large-diameter sprocket") 30*a*. More detailed description will be given. These large-diameter sprockets 30*a* are so constituted that the following can be implemented: the sprockets 30*a* can be integrally assembled to the housing members 10 of the valve timing adjusting apparatuses 1 for intake as the first rotating body illustrated in FIG. 3, together with sprockets 30*b* described later. The housing member 10 and the sprocket portion 30 having the large-diameter sprocket 30*a* and a small-diameter sprocket 30*b* constitute a valve timing adjusting apparatus 1 for intake.

A first timing chain 5*a* is looped over the crank sprocket 9*a* and both the large-diameter sprockets 30*a*. Thus, the rotation of the crankshaft 9 is transmitted to the intake-side camshafts 3 through the first timing chain 5*a*. More detailed description will be given. As illustrated in FIG. 1, an idler 209 is disposed in position in front of the cylinder blocks 200, and dampers 231 are disposed in the valley between both the large-diameter sprockets 30*a* and the idler 209. A chain tensioner 211 and a chain guide 221 are respectively disposed between the large-diameter sprocket 30*a* in the right bank RH and the crank sprocket 9*a* and between the large-diameter sprocket 30*a* in the left bank LH and the crank sprocket 9*a*. The chain tensioner 211, chain guide 221, idler 209, and dampers 231 remove slack in the first timing chain 5*a* and dispose the first timing chain 5*a* in position between the both the large-diameter sprockets 30*a* and the crank sprocket 9*a*. The chain tensioner 211 is an apparatus for automatically adjusting the tension of the first timing chain 5*a* as predetermined.

To transmit the rotation of the intake-side camshaft 3 to the exhaust-side camshaft 4 in each bank RH and LH, a sprocket (hereafter, referred to as "small-diameter sprocket") 30*b* is integrally installed at the tip (front end) of each exhaust-side camshaft 4 and each intake-side camshaft 3. More detailed description will be given. This small-diameter sprocket 30*b* is so constituted that it can be integrally assembled to the housing member 10 of the valve timing adjusting apparatus 2 for exhaust as second rotating body. The housing member 10 and the sprocket portion 30 having the small-diameter sprocket 30*b* constitute a valve timing adjusting apparatus 2 for exhaust.

Hereafter, the components of the valve timing adjusting apparatuses 1 for intake will be suffixed with a parenthesized numeral 1 for the simplicity of explanation. For example, the housing member 10 is expressed as housing member 10(1). The components of the valve timing adjusting apparatus 2 for exhaust will be suffixed with a parenthesized numeral 2. For example, the housing member 10 is expressed as housing member 10(2). Thereby, the components of the valve timing adjusting apparatuses 1 for intake and the components of the valve timing adjusting apparatuses 2 for exhaust are discriminated from each other. The suffixed numeral 1 indicates the components of the valve timing adjusting apparatuses 1 for intake, and the suffixed numeral 2 indicates the components of the valve timing adjusting apparatuses 2 for exhaust.

A second timing chain 5*b* is looped over the small-diameter sprocket 30*b*(1) and the small-diameter sprocket 30*b*(2) positioned in the same bank RH and LH. Thus, the rotation of the intake-side camshafts 3 is transmitted to the exhaust-side camshafts 4 through the second timing chains 5*b*. More detailed description will be given. A chain tensioner 212 is disposed between the small-diameter sprocket 30*b*(1) and the small-diameter sprocket 30*b*(2). The chain tensioner 212 is an apparatus which automatically adjusts the tension of the second timing chain 5*b* as predetermined by pressing force by pressing the second timing chain 5*b* outward or performing like operation.

When the positional relation between the first timing chain 5*a*, second timing chains 5*b*, sprockets 30*a* and 30*b*, and crank sprocket 9*a* is described below, the following procedure will be taken: as illustrated in FIG. 5, the apparatuses, such as chain tensioners 211 and 212, chain guide 221, and dampers 231, for removing slack in the timing chains 5*a* and 5*b* will be omitted. The description will be given on the assumption that, when the timing chains 5*a* and 5*b* are looped over the sprockets 30*a*, 30*b*, and 9*a*, there is no slack in the chains.

Next, description will be given to the constitution of the valve timing adjusting apparatus 1, referring to FIG. 3, FIG. 4, and FIG. 5. FIG. 4 shows the valve timing adjusting apparatus 1 for intake and the valve timing adjusting apparatus 2 for exhaust disposed on the right bank RH side as viewed in the direction of R in FIG. 1. FIG. 3 is a longitudinal sectional view of the valve timing adjusting apparatus 1 for intake and the valve timing adjusting apparatus 2 for exhaust. FIG. 3 includes the following: the longitudinal sectional view of the valve timing adjusting apparatus 1 for intake, taken along the line IIIA—IIIA of FIG. 4 which is a cross-sectional view of the valve timing adjusting apparatus 1; the longitudinal sectional view of the valve timing adjusting apparatus 2 for exhaust, taken along the line IIIB—IIIB of FIG. 4. The timing adjusting apparatus 2 for exhaust valve will be described in detail first. With respect to the valve timing adjusting device 1 for intake, the components identical with or equivalent to those of the valve timing adjusting apparatus 2 for exhaust will be marked with the identical numerals. With respect to those components, description will not be repeated. For the simplicity of explanation, the numerals will be suffixed with parenthesized numerals to discriminate the constituent members of the valve timing adjusting apparatus 1 for intake and the constituent members of the valve timing adjusting apparatus 2 for exhaust from each other.

As illustrated in FIG. 3, the valve timing adjusting apparatus 2 for exhaust comprises: a shoe housing 10(2) as housing member and a sprocket portion 30(2). The small-diameter sprocket 30*b*(2) on which a gear string is formed is provided on the side of the periphery of the sprocket portion 30(2). The turning force of the intake-side camshaft 3 is transmitted to the exhaust-side camshaft 4 through the second timing chain 5*b* looped over the small-diameter sprockets 30*b*(1) and 30*b*(2). The second timing chain 5*b* and the small-diameter sprockets 30*b* constitute the second driving force transmitting member. The small-diameter sprocket 30*b* and the camshaft 4 are rotated clockwise as viewed from the left of FIG. 1. Hereafter, this direction of rotation will be taken as the direction of advance angle. The shoe housing 10(2) and the sprocket portion 30(2) constitute the driving-side rotating body portion which is rotated in synchronization with the crankshaft 9. The shoe housing 10(2) and the sprocket portion 30(2) are coaxially fixed together by bolts 31.

The shoe housing 10 comprises a peripheral wall 11 and a front plate 12, and they are integrally formed substantially in bowl shape. The peripheral wall 11 and the front plate 12 may be fixed together with the sprocket portion 30 by the bolts 31. As illustrated in FIG. 4, the shoe housing 10 has insular portions (hereafter, referred to as "shoes") 10*a*, 10*b*, 10*c*, and 10*d* which are formed insubstantially trapezoidal shape at substantially equal intervals in the circumferential direction. In the four gaps between the shoes 10*a*, 10*b*, 10*c*, and 10*d* in the circumferential direction, fan-shaped holding chambers 14 are formed for housing vanes 50*a*, 50*b*, 50*c*, and 50*d* as vane rotor members. The inner wall faces of the shoes 10*a*, 10*b*, 10*c*, and 10*d* are so formed that their cross sections are in substantially arc shape (Refer to FIG. 4). The shoes 10*a*, 10*b*, 10*c*, and 10*d* are disposed side by side in the direction of the circumference of the holding chambers 14. The inner wall faces of the shoes 10*a*, 10*b*, 10*c*, and 10*d* define the holding chambers 14.

As illustrated in FIG. 4, the shoe housing 10 has cutoff shape portions 60*a* and 60*b* formed on the side of the outer circumference of the peripheral wall 11. The cutoff shape portions 60*a* and 60*b* are formed on the periphery of the portions of the shoe housing 10 (more specifically, the peripheral wall 11 and the front plate 12) where the shoes 10*a* and 10*c* are disposed. As illustrated in FIG. 4, the cutoff shape portions 60*a* and 60*b* are formed in such a contour that the following is implemented: the cutoff shape portions are at a shorter distance from the center of rotation than the circumferential portion is. The circumferential portion makes up the major portion of the peripheral shape of the peripheral wall 11(2) and the front plate 12 (hereafter, referred to as "peripheral wall 11"). The constitution of the cutoff shape portions 60*a* and 60*b* is not limited to such a constitution that the circumferential portion is cut off straight. The cutoff shape portion may have a contour comprising two straight lines at an angle.

FIG. 4 and FIG. 5 illustrate a state produced when the timing adjusting apparatuses 2 for exhaust and the valve timing adjusting apparatuses 1 for intake are assembled to the camshafts 3 and 4 on the engine body side. In this state, at least the valve timing adjusting apparatuses 2 for exhaust are disposed in a predetermined rotation angle position. This predetermined rotation angle position is an assembling angle position in which the following is performed: the valve timing adjusting apparatuses 1 for intake and the valve timing adjusting apparatuses 2 for exhaust are respectively assembled and fixed to the intake-side camshafts 3 and the exhaust-side camshafts 4 with the aid of positioning pins 51(1) and 51(2).

The cutoff shape portion 60*a* forms a predetermined gap $\Delta L_R$ wider than the gap between the circumferential portion of the peripheral wall 11(2) and the periphery of the valve timing adjusting apparatus 1 for intake. This gap $\Delta L_R$ is large enough for the first timing chain 5*a* to be inserted in between the circumferential portion of the peripheral wall 11(2) and the valve timing adjusting apparatus 1 for intake (more specifically, the large-diameter sprocket 30*a*) (Refer to FIG. 6).

The cutoff shape portion 60*a* constitutes a looping means for implementing the following after the valve timing adjusting apparatuses 2 for exhaust and the valve timing adjusting apparatuses 1 for intake are assembled to the camshafts 3 and 4 on the engine body side: the first timing chain 5*a* is looped over the valve timing adjusting apparatuses 1 for intake (more specifically, the large-diameter sprockets 30*a*).

In this embodiment, the cutoff shape portions 60*a* and 60*b* formed in the peripheral wall 11(2) are substantially axisymmetrically disposed, as illustrated in FIG. 4. The cutoff shape portions 60*a* and 60*b* are so formed that they are symmetrical with respect to a predetermined cross section including the central axis of rotation. In more detail, the cutoff shape portions 60*a* and 60*b* are formed in a contour having two straight lines at an angle, as illustrated in FIG. 4. Four contours as cutoff shape portions are symmetrically formed with respect to a cross section including the central axis of rotation. Thus, in the cutoff shape portions 60*a* and 60*b* formed in the peripheral wall (2) of the valve timing adjusting apparatus 2 for exhaust in the left bank LH, the following is implemented: the cutoff shape portion 60*b* positioned in the assembling angle position has the gap $\Delta L_R$ large enough for the first timing chain 5*a* to be inserted in between it and the periphery of the valve timing adjusting apparatus 1 for intake.

In this embodiment, as illustrated in FIG. 4, the peripheral shape of the valve timing adjusting apparatus 2 for exhaust (more specifically, peripheral wall 11) having the cutoff shape portions 60*a* and 60*b* is of compressed circle.

As illustrated in FIG. 4, the rotor 50 has vanes 50*a*, 50*b*, 50*c*, and 50*d* at substantially equal intervals in the circumferential direction. The vanes 50*a*, 50*b*, 50*c*, and 50*d* are rotatably housed in the respective holding chambers 14. Each vane divides each holding chamber 14 into a retard angle hydraulic chamber and an advance angle hydraulic chamber. The rotor 50(2) and the vanes 50*a*, 50*b*, 50*c*, and 50*d* constitute a vane rotor member. The vanes 50*a*, 50*b*, 50*c*, and 50*d* are rotated in each holding chamber 14, that is, between insular portions so that their rotation angle is limited to within a predetermined range.

As illustrated in FIG. 3, a positioning pin 51(2) for positioning the valve timing adjusting apparatus 2 for exhaust and the exhaust-side camshaft 4 is disposed between the rotor 50(2) and the camshaft 4. After the mounting angle of the rotor 50(2) is determined by the positioning pin 51(2), the rotor 50(2) is integrally fixed on the camshaft 4 by a bolt 20. The rotor 50(2), vanes 50*a*, 50*b*, 50*c*, and 50*d*, and positioning pin 51(2) constitute a driven-side rotating body portion which is rotated in synchronization with the exhaust-side camshaft 4. The camshaft 4, rotor 50(2), and vanes 50*a*, 50*b*, 50*c*, and 50*d* are coaxially rotatable relative to the shoe housing 10(2) and the sprocket 30(2).

As illustrated in FIG. 3 and FIG. 4, shoe seals 53 are fit onto the outer circumferential wall of the vane rotor 50. Minute clearances are provided between the outer circumferential wall of the vane rotor 50 and the inner circumferential wall of the peripheral wall 11. The shoe seals 53 prevent working oil from leaking out to between the hydraulic chambers through these clearances. The shoe seals 53 are energized toward the peripheral wall 11 by the energizing force of leaf springs (not shown). The shoe seals 53 are disposed at the portions of the inner circumferential wall of the peripheral wall 11 corresponding to the clearances formed between the inner walls of the shoes 10*a*, 10*b*, 10*c*, and 10*d* and the outer circumferential wall of the vane rotor 50 (Refer to FIG. 4).

As illustrated in FIG. 3, a stopper piston 71 formed in substantially annular shape is housed in the vane 50*d* so that the piston can be slid in the direction of the axis of rotation of the camshaft 4. A fitting ring 72 is press fit and held in a recess formed in the sprocket portion 30. The stopper piston 71 can be abutted against and fit in the fitting ring 72. A spring 73 energizes the stopper piston 71 toward the fitting ring 72. The tip of the stopper piston 71 can be fit into the fitting ring 72 when the vane rotor 50 is positioned in the maximum advance angle position relative to the shoe housing 10. With the stopper piston 71 fit in the fitting ring 72, the rotation of the vane rotor 50 relative to the shoe housing 10 is constrained. When the vane rotor 50 is rotated from the maximum advance angle side toward the retard angle side relative to the shoe housing 10, the position of the stopper piston 71 and the position of the fitting ring 72 are shifted from each other in the circumferential direction. Thus, the stopper piston 71 becomes incapable of being fit into the fitting ring 72.

The stopper piston 71 and the fitting ring 72 constitute a rotation angle phase anchoring means 70. The means 70 is capable of anchoring the shoe housing 10 and the vane rotor 50, that is, the driving-side rotating body portion and the driven-side rotating body portion, in a substantially intermediate position (the maximum advance angle position in this embodiment) within a predetermined range of rotation angle.

As illustrated in FIG. 4, an advance angle hydraulic chamber is formed between the shoe 10*a* and the vane 50*a*; an advance angle hydraulic chamber is formed between the shoe 10*b* and the vane 50*b*; an advance angle hydraulic chamber is formed between the shoe 10*c* and the vane 50*c*; and an advance angle hydraulic chamber is formed between the shoe 10*d* and the vane 50*d*. A retard angle hydraulic chamber is formed between the shoe 10*b* and the vane 50*a*; a retard angle hydraulic chamber is formed between the shoe 10*c* and the vane 50*b*; a retard angle hydraulic chamber is formed between the shoe 10*d* and the vane 50*c*; and a retard angle hydraulic chamber is formed between the shoe 10*a* and the vane 50*d*. As illustrated in FIG. 3, oil passages 91 and 92 are connected to change-over valves 100, respectively, through oil passages 93 and 94. An oil supply path 101 for supplying working fluid is connected to an oil pump 102, and an oil discharge path 103 for discharging working fluid is open toward a drain 104. The oil pump 102 supplies working oil, pumped up out of the drain 104, to the hydraulic chambers through the change-over valves 100. The change-over valve 100 is a publicly known four-port pilot valve. The valve member 105 of the change-over valve 100 is energized in one direction by a spring 106, and is reciprocated by controlling power application to a solenoid 107. Power application to the solenoid 107 is controlled by ECU (not shown). By the valve members 105 reciprocating, combinations of connection and disconnection of the oil passages 93 and 94, oil supply path 101, and oil discharge path 103 are changed. With the above-mentioned constitution of the oil passages, working oil can be supplied from the oil pump 102 to the advance angle hydraulic chambers, retard angle hydraulic chambers, or hydraulic chambers 121 (Refer to FIG. 3). Further, working oil can be discharged from each hydraulic chamber to the drain 104.

As illustrated in FIG. 3, a spring 21 is housed in the annular housing portion formed in a spring plate 29. One end 21*a* of the spring 21 is anchored to a pin 22 protruded from the front plate 12. The other end 21*b* of the spring 21 is anchored to the fixing groove 54*a* formed in the bolt bearing surface 54 of the rotor 50(1). The load torque the exhaust-side camshaft 4 receives when the camshaft 4 drives exhaust valves 7 positively or negatively fluctuates. The positive side of the load torque energizes the rotor 50 to the retard angle side relative to the shoe housing 10. The negative side of the load torque energizes the rotor 50 to the advance angle side relative to the shoe housing 10. The average value of load torque acts to the positive side, that is, the retard angle side. The energizing force of the spring 21 acts as torque which rotates the vane rotor 50 to the advance angle side relative to the shoe housing 10. The torque in the direction of advance angle the spring 21 applies to the rotor 50 is maximized when the rotor 50(2) is in the maximum retard angle position relative to the shoe housing 10. The torque is decreased as the rotor goes in the direction of advance angle. The spring 21 constitutes an advance angle aiding means which energizes the rotor 50(2) to the advance angle side (in the direction of rotation angle).

As illustrated in FIG. 3, the valve timing adjusting apparatus 1 for intake comprises a shoe housing 10(1) and a sprocket portion 30(1). On the side of the periphery of the sprocket portion 30(1), a small-diameter sprocket 30*b*(1) on which a gear string is formed and a large-diameter sprocket 30*a*(1) having a gear string, larger than that of the small-diameter sprocket 30*b*(1), are disposed. The driving force of the crankshaft 9 is transmitted to the intake-side camshafts 3 through the first timing chain 5*a* looped over the crank sprocket 9*a* and the large-diameter sprockets 30*a* in both the banks RH and LH. The first timing chain 5*a* and the large-diameter sprockets 30*a* constitute a first driving force transmitting member. The shoe housing 10(1) and the sprocket portion 30(1) constitute a driving-side rotating body portion which is rotated in synchronization with the crankshaft 9. The shoe housing 10(1) and the sprocket portion 30(1) are coaxially fixed together by bolts 31. As illustrated in FIG. 4, the shoe housing 10 has shoes 10*a*, 10*b*, and 10*c* which are formed in substantially trapezoidal shape at substantially equal intervals in the circumferential direction. In the three gaps between the shoes 10*a*, 10*b*, and 10*c* in the circumferential direction, fan-shaped holding chambers 14 are formed for housing vanes 50*a*, 50*b*, and 50*c* as vane rotor member. The inner wall faces of the shoes 10*a*, 10*b*, and 10*c* are so formed that their cross sections are in substantially arc shape (Refer to FIG. 4).

As illustrated in FIG. 4, the rotor 50 has the vanes 50*a*, 50*b*, and 50*c* at substantially equal intervals in the circumferential direction. The vanes 50*a*, 50*b*, and 50*c* are rotatably housed in the respective holding chambers 14. Each vane divides the respective holding chamber 14 into a retard angle hydraulic chamber and an advance angle hydraulic chamber. The rotor 50(1) and the vanes 50*a*, 50*b*, and 50*c* constitute a vane rotor member. The vanes 50*a*, 50*b*, and 50*c* are rotated in the respective holding chambers 14, that is, between insular portions so that their rotation angle is limited to within a predetermined range.

As illustrated in FIG. 3, a positioning pin 51(1) for positioning the valve timing adjusting apparatus 1 for intake and the intake-side camshaft 3 is disposed between the rotor 50(1) and the camshaft 3. The rotor 50(1) and the positioning pin 51(1) are integrally fixed on the camshaft 3 by a bolt 20. The rotor 50 (1), vanes 50*a*, 50*b*, and 50*c*, and positioning pin 51(1) constitute a driven-side rotating body portion which is rotated in synchronization with the intake-side camshaft 3. The camshaft 3, rotor 50(1) and vanes 50*a*, 50*b*, and 50*c* are coaxially rotatable relative to the shoe housing 10(1) and the sprocket 30(1).

As illustrated in FIG. 3, a stopper piston 71 formed in substantially annular shape is housed in the vane 50*a* so that the piston can be slid in the direction of the axis of rotation of the camshaft 3. A fitting ring 72 is press fit and held in a recess formed in the shoe housing 10. The stopper piston 71 can be abutted against and fit in the fitting ring 72. A spring 73 energizes the stopper piston 71 toward the fitting ring 72. The tip of the stopper piston 71 can be fit into the fitting ring 72 when the vane rotor 50 is positioned in the maximum retard angle position relative to the shoe housing 10. With the stopper piston 71 fit in the fitting ring 72, the rotation of the vane rotor 50 relative to the shoe housing 10 is constrained. When the vane rotor 50 is rotated from the maximum retard angle side toward the advance angle side relative to the shoe housing 10, the position of the stopper piston 71 and the position of the fitting ring 72 are shifted from each other in the circumferential direction. Thus, the stopper piston 71 becomes incapable of being fit into the fitting ring 72. The following constitution may be adopted: the stopper piston 71 is housed so that the piston can be slid in the direction of the axis of rotation of the camshaft 3 by a guide ring 74 press fit and held in the vane 50*a*.

Here, description will be given to a method for assembling the valve timing adjusting apparatuses 1 for intake and the valve timing adjusting apparatuses 2 for exhaust to an engine, referring to FIG. 6, FIG. 7, FIG. 8, FIG. 9, and FIG. 10.

First, as illustrated in FIG. 8, the rotation angle positions of the camshafts 3 and 4 of the engine are matched with that of the crankshaft 9. With respect to the intake-side camshaft 3 and the exhaust-side camshaft 4 in the left bank LH, the first cylinder in the left bank LH is positioned at the compression top dead center. The crankshaft 9 is brought into a state θ9 in which it lags from the compression top dead center of the first cylinder by a predetermined retard angle. (More specifically, the crankshaft 9 translates to the timing mark TM9 position on a timing rotor 291 which is rotated integrally with the crankshaft 9.) With respect to the intake-side camshaft 3 and the exhaust-side camshaft 4 in the right bank RH, the first cylinder may be positioned at the compression top dead center. Or, the camshafts 3 and 4 may be positioned at a predetermined crank rotation angle at which they stably stand. Hereafter, with respect to the intake-side camshaft 3 and the exhaust-side camshaft 4 in the right bank RH, a predetermined crank rotation angle where the camshafts 3 and 4 stably stand is taken as the assembling rotation angle position.

Next, the second timing chains 5*b* are looped over the small-diameter sprockets 30*b* of the valve timing adjusting apparatuses 1 for intake and the valve timing adjusting apparatuses 2 for exhaust. At this time, each chain is looped with the mark of the chain 5*b* aligned with the sprocket 30*b*-side timing mark. In the right bank RH, the stm1 mark of the small-diameter sprocket 30*b*(1) is aligned with the link mark rtm1 of the chain 5*b*; and the stm2 mark of the small-diameter sprocket 30*b*(2) is aligned with the link mark rtm2 of the chain 5*b*. Similarly, in the left bank LH, the stm1 mark of the small-diameter sprocket 30*b*(1) is aligned with the rtm1 mark of the chain 5*b*; and the stm2 mark of the small-diameter sprocket 30*b*(2) is aligned with the link mark rtm2 of the chain 5*b*.

The valve timing adjusting apparatuses 1 for intake and the valve timing adjusting apparatuses 2 for exhaust are assembled to the intake-side camshafts 3 and the exhaust-side camshafts 4 through the positioning pins 51.

At this time, the gap $\Delta L_R$ widened by the cutoff shape portions 60*a* and 60*b* is provided between the valve timing adjusting apparatuses 1 for intake and the valve timing adjusting apparatuses 2 for exhaust. With this gap in-between, the valve timing adjusting apparatuses 1 for intake and the valve timing adjusting apparatuses 2 for exhaust are assembled and fixed.

Next, the first timing chain 5*a* is looped over the large-diameter sprockets 30*a* of both the valve timing adjusting apparatuses 1 for intake and the crank sprocket 9, as illustrated in FIG. 9 and FIG. 10. The first timing chain 5*a* is looped over the large-diameter sprockets 30*a* of the valve timing adjusting apparatuses 1 for intake as illustrated in FIG. 6 in which the gap $\Delta L_R$ is widened. Therefore, the first timing chain 5*a* can be inserted in between the valve timing adjusting apparatuses 1 for intake and the valve timing adjusting apparatuses 2 for exhaust. As illustrated in FIG. 7 and FIG. 3, the first timing chain 5*a* can be looped to the periphery of the large-diameter sprockets 30*a*.

Next, the action and effect of this embodiment will be described.

(1) When conventional substantially cylindrical valve timing adjusting apparatuses 1 for intake and valve timing adjusting apparatuses 2 for exhaust are mounted on an engine with the limited center distance $\Delta L$ between intake-side and exhaust-side camshafts 3 and 4, a problem arises. Because of the limited center distance $\Delta L$, the gap between the valve timing adjusting apparatus 1 for intake and the valve timing adjusting apparatus 2 for exhaust is made too small to perform the following: an endless member for power transmission, such as a timing chain 5*a*, is passed through the gap. As a result, ease of mounting the valve timing adjusting apparatuses 1 for intake and the valve timing adjusting apparatuses 2 for exhaust on the engine can be degraded.

Meanwhile, in this embodiment, a cutoff shape portion 60*a* is provided with respect to the peripheral shape of the valve timing adjusting apparatuses 2 for exhaust. When the valve timing adjusting apparatuses 1 for intake and the valve timing adjusting apparatuses 2 for exhaust are assembled to the internal combustion engine, this cutoff shape portion 60*a* plays an effective role. The cutoff shape portion 60*a* provides a gap $\Delta L_R$ so widened that the timing chain 5*a* can be inserted therein only when the timing adjusting apparatus 2 for exhaust is positioned in an assembling position at a predetermined rotation angle. Therefore, the cutoff shape portion 60*a* only has to be formed in part of the periphery of cylindrical shape. Thus, the mountability of the valve timing adjusting apparatuses 1 and 2 for intake valves and for exhaust valves can be enhanced with their shape remaining substantially cylindrical.

(2) In this embodiment, the cutoff shape portion 60*a* formed on the periphery of the substantially cylindrical valve timing adjusting apparatus 2 for exhaust is effective even after the following operation: it is effective even after the valve timing adjusting apparatuses 1 and 2 for intake valves and for exhaust valves are assembled to the driven shafts of an internal combustion engine. As a looping means, the cutoff shape portion 60*a* is capable of forming a gap for looping the timing chain 5*a* over the valve timing adjusting apparatuses 1 for intake. Therefore, the assembling workability can be enhanced. The work of looping the second timing chains 5*b* over the small-diameter sprockets 30*b*(1) and 30*b*(2) and the work of looping the first timing chain 5*a* over the large-diameter sprockets 30*a* of the valve timing adjusting apparatuses 1 for intake can be separately carried out. Therefore, the assembling work is facilitated.

(3) A part of the peripheral shape of the valve timing adjusting apparatuses 2 for exhaust is formed as a cutoff shape portion 60*a*. Therefore, the valve timing adjusting apparatuses 2 for exhaust only have to be formed in compressed circular shape. Thus, the mountability of the valve timing adjusting apparatuses 1 and 2 for intake valves and for exhaust valves can be ensured when they remain substantially circular, that is, in substantially cylindrical shape.

(4) The cutoff shape portion 60*a* formed on the periphery of the valve timing adjusting apparatus 2 for exhaust is so sized that the following conditions will be met: the peripheral length of the cutoff shape portion 60*a* is made equal to or larger than the pitch length $R_p$ equivalent to at least one roller of the timing chain 5*a*. The timing chain 5*a* has flexibility with respect to each of basic elements for coupling, or so-called rollers (For the pitch length $R_p$, refer to FIG. 6). Therefore, a gap through which the timing chain 5*a* can be passed can be ensured between the timing adjusting apparatuses 1 for intake valves and the valve timing adjusting apparatuses 2 for exhaust.

(5) The cutoff shape portion 60*a* is provided in the shoe 10*a* formed in the shoe housing 10, positioned outside the operating range of the vanes 50*a*, 50*b*, 50*c*, and 50*d* of the vane rotor member. Therefore, the cutoff shape portion 60*a* can be formed without reducing the vane radius of the vane rotor member.

(6) The present invention is favorably applicable to valve timing adjusting apparatuses having a rotation angle phase anchoring means 70 which is capable of anchoring the vane 50*d* and the shoe housing 10 in the following predetermined position: a position between the maximum advance angle and the maximum retard angle within a predetermined range of rotation angle. The rotation angle phase anchoring means 70 is capable of integrally rotating the vane rotor member and the housing member in a predetermined rotation angle position. Therefore, when the valve timing adjusting apparatuses 1 and 2 for intake valves and for exhaust valves are assembled to an internal combustion engine, the means 70 is capable of the following: it is capable of anchoring the vane rotor member and the housing member in a rotation angle position formed in the gap $\Delta L_R$ through which the first timing chain 5*a* can be passed.

(7) The valve timing adjusting apparatus of the present invention is characterized by the following: two or more cutoff shape portions 60*a* and 60*b* are symmetrically disposed with respect to a cross section including the central axis of rotation. Thus, when the valve timing adjusting apparatus is used in a V-type internal combustion engine or the like, it can be used both for the left bank and for the right bank.

(8) The present invention is favorably applicable to so-called V-type internal combustion engines. The V-type internal combustion engine has two sets of camshafts, each set comprising an intake-side camshaft 3 and an exhaust-side camshaft 4. At the same time, the angle at which the inclined central axes of the cylinder bores 8 in these sets intersect each other is a predetermined bank angle. Even if slack in the timing chain 5*a* due to its own weight, disposed in the cylinder blocks 200 inclinedly disposed at a predetermined bank angle, is taken into account when the shape of the cutoff shape portions 60*a* and 60*b* is formed, the following advantage is obtained: the mountability of the valve timing adjusting apparatuses 1 and 2 for intake valves and for exhaust valves can be ensured with their substantially cylindrical shape maintained.

Another Embodiment

Another embodiment will be described referring to FIG. 11. In the following description, the members identical with or equivalent to those of the above-mentioned embodiment will be marked with the identical numerals. With respect to those members, description will not be repeated.

Figure 11:
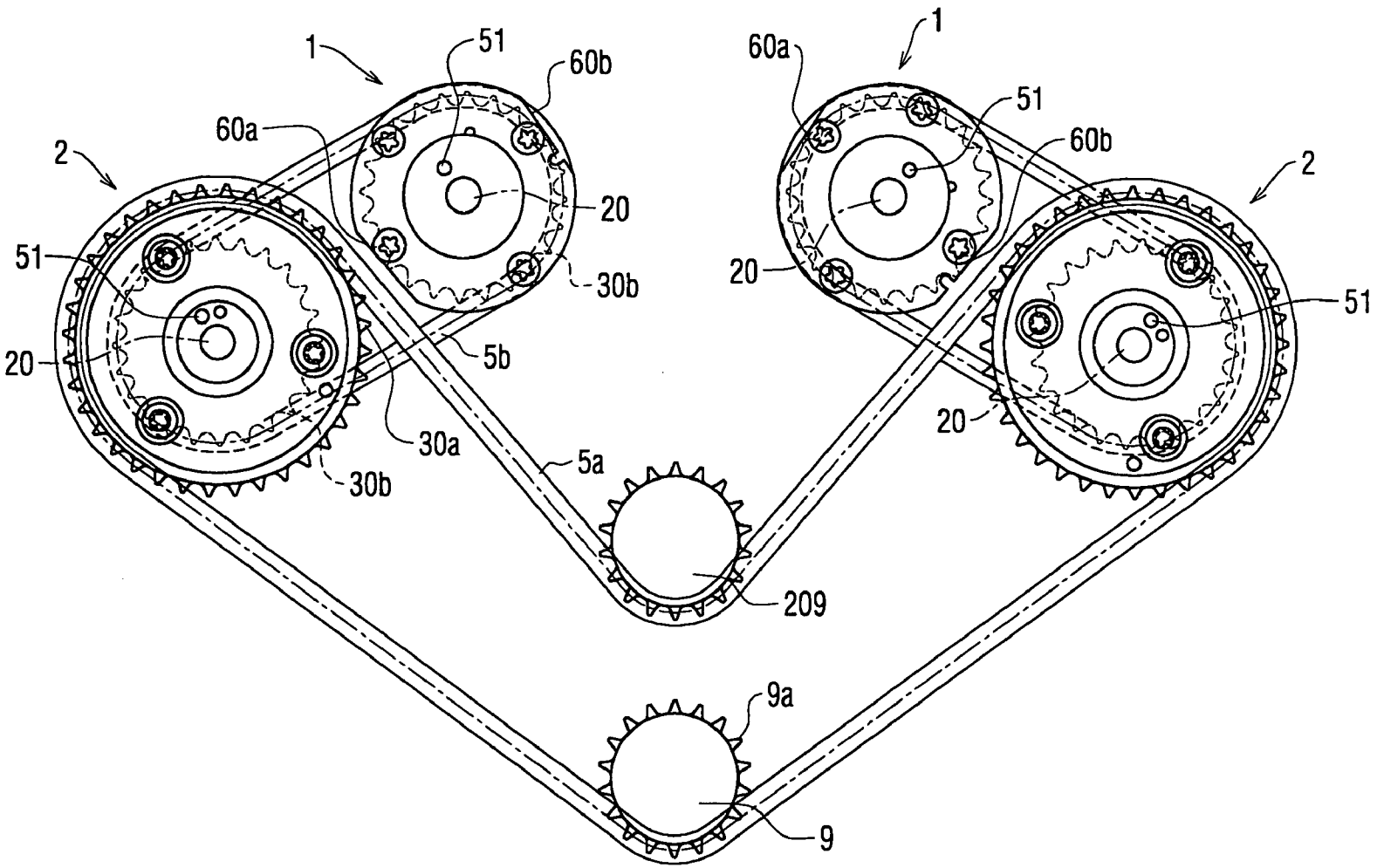
FIG. 11 is a schematic front view illustrating the positional relation between the first and second rotating bodies and the driving force transmission system in another embodiment.

In this embodiment, as illustrated in FIG. 11, the first timing chain 5*a* for transmitting the driving force of the crankshaft 9 is not looped over the valve timing adjusting apparatuses 1 for intake valves, unlike the above-mentioned embodiment. Instead, the first timing chain 5*a* is looped over the valve timing adjusting apparatuses 2 for exhaust valves.

The valve timing adjusting apparatus 2 for exhaust comprises a shoe housing 10(2) and a sprocket portion 30(2). On the side of the periphery of the sprocket portion 30(2), a small-diameter sprocket 30*b*(2) and a large-diameter sprocket 30*a*(1) are disposed. The driving force of the crankshaft 9 is transmitted to the exhaust-side camshafts 4 through the first timing chain 5*a* looped over the crank sprocket 9*a* and the large-diameter sprockets 30*a* in both the banks RH and LH. The valve timing adjusting apparatus 1 for intake comprises a shoe housing 10(1) and a sprocket portion 30(1). On the side of the periphery of the sprocket portion 30(1), a small-diameter sprocket 30*b*(1) is disposed. The turning force of the exhaust-side camshafts 4 is transmitted to the intake-side camshafts 3 through the second timing chains 5*b* looped over the small-diameter sprockets 30*b*(1) and 30*b*(2). As illustrated in FIG. 11, cutoff shape portions 60*a* and 60*b* are formed on the side of the periphery of the valve timing adjusting apparatuses 2 for exhaust.

With this constitution, the same effect as in the above-mentioned embodiment is obtained.

Next, the action and effect of this embodiment will be described.

The present invention is favorably applicable to internal combustion engines in which two intake-side camshafts 3 open and close intake valves mounted in left and right banks RH and LH and two exhaust-side camshafts 4 and open and close exhaust valves. Either of the intake-side camshafts 3, either of the exhaust-side camshafts 4, and the crankshaft 9 are driven using one first timing chain 5*a*. For example, when the first timing chain 5*a* is replaced in market services, the first timing chain 5*a* can be removed and replaced with new one without extensive removing and reinstalling work. Such extensive work includes removal of valve timing adjusting apparatuses from an internal combustion engine.

The above embodiments have been described based on the V-type six-cylinder engine. However, the present invention is applicable to in-line six-cylinder engines if the center distance $\Delta L$ between intake-side and exhaust-side camshafts 3 and 4 is restricted.

What is claimed is:

1. A valve timing adjusting apparatus, comprising:

a first rotating body which is provided on a first driving force transmitting member for transmitting driving force from the driving shaft of an internal combustion engine to driven shafts for opening and closing either intake valves or exhaust valves, and adjusts the opening/closing timing of the either; and a second rotating body which is provided on a second driving force transmitting member for transmitting the turning force of the first rotating body to the other driven shaft, and adjusts the opening/closing timing of the other, wherein the first driving force transmitting member and the second driving force transmitting member respectively have a first endless member for power transmission and a second endless member for power transmission, the peripheral shape of the second rotating body has a circumferential shape portion and cutoff shape portions of which distance from the center of rotation is shorter than a distance from the center of rotation to the circumferential shape portion, and the first rotating bodies and the second rotating bodies are assembled to the internal combustion engine in such a manner that the cutoff shape portions are positioned in such a rotation angle position that the first endless member for power transmission can be inserted in between the first rotating bodies and the second rotating bodies.

2. A valve timing adjusting apparatus, comprising:

a first rotating body which is provided on a first driving force transmitting member for transmitting driving force from the driving shaft of an internal combustion engine to driven shafts for opening and closing either intake valves or exhaust valves, and adjusts the opening/closing timing of the either, and a second rotating body which is provided on a second driving force transmitting member for transmitting the turning force of the first rotating body to the other driven shaft and adjusts the opening/closing timing of the other, wherein the first driving force transmitting member and the second driving force transmitting member respectively have a first endless member for power transmission and a second endless member for power transmission, the peripheral shape of the second rotating body has a circumferential shape portion and cutoff shape portions of which distance from the center of rotation is shorter than a distance from the center of rotation to the circumferential shape portion, and the cutoff shape portions constitute a looping means for looping the first endless member for power transmission over the first rotating bodies with the first rotating bodies and the second rotating bodies being assembled to the internal combustion engine.

3. The valve timing adjusting apparatus according to claim 1, wherein the peripheral shape of the second rotating bodies is compressed circle.

4. The valve timing adjusting apparatus according to claim 1, wherein the first endless member for power transmission is a timing chain, and the peripheral length of the cutoff shape portion is equal to or larger than the pitch length of at least one of a plurality of basic elements for coupling which constitute the timing chain.

5. The valve timing adjusting apparatus according to claim 1, wherein the second rotating body comprises a housing member which is rotated together with the second endless member for power transmission, and a vane rotor member which is housed in a holding chamber formed in a housing member and is rotated between insular portions formed side by side in a direction of a circumference of the holding chamber so that a rotation angle of the vane rotor member is limited to within a predetermined range, and the cutoff shape portions are provided in the insular portions.

6. The valve timing adjusting apparatus according to claim 5, wherein a rotation angle phase anchoring means is provided, which is capable of anchoring the vane rotor member and the housing member in position between a maximum advance angle and a maximum retard angle within a predetermined range of rotation angle.

7. The valve timing adjusting apparatus according to claim 1, wherein two or more cutoff shape portions are symmetrically disposed with respect to a predetermined cross section including a central axis of rotation.

8. The valve timing adjusting apparatus according to claim 1, wherein the internal combustion engine has two sets of driven shafts, each set comprising two driven shafts, and the angle at which the inclined central axes of the cylinder bores in these sets intersect each other is a predetermined bank angle.

9. The valve timing adjusting apparatus according to claim 8, wherein the driving force from the driving shaft is transmitted through one of the first endless members for power transmission to either of the two driven shafts for opening and closing the intake valves and either of the two driven shafts for opening and closing and driving the exhaust valves of the two sets.

10. The valve timing adjusting apparatus according to claim 2, wherein the peripheral shape of the second rotating bodies is compressed circle.

* * * * *